US006674872B2

(12) United States Patent
Fujinami et al.

(10) Patent No.: US 6,674,872 B2
(45) Date of Patent: Jan. 6, 2004

(54) SPEAKER

(75) Inventors: Naohiro Fujinami, Shizuoka (JP); Fuminori Moritake, Shizuoka (JP); Tomoyuki Sato, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 0 days.

(21) Appl. No.: 10/151,012

(22) Filed: May 21, 2002

(65) Prior Publication Data

US 2002/0176596 A1 Nov. 28, 2002

(30) Foreign Application Priority Data

May 23, 2001 (JP) ..... 2001-154599

(51) Int. Cl.[7] ..... H04R 25/00
(52) U.S. Cl. ..... 381/409; 381/420
(58) Field of Search ..... 381/409, 410, 381/396, 412, 430

(56) References Cited

U.S. PATENT DOCUMENTS 6,385,328 B1 * 5/2002 Yoo et al. ..... 381/412

* cited by examiner

*Primary Examiner*—Sinh Tran
(74) *Attorney, Agent, or Firm*—Sughrue Mion, PLLC

(57) ABSTRACT

A pair of lead wire drawn from a voice coil is fixed to a land portion of a pair of terminal member by thermo-compression bonding. The pair of terminal member is integrally formed with the frame by insert molding. The frame made of synthetic resin has a pair of circular holes on the back side of the land portion to expose the land portion to the back space of the frame. In thermo-compression bonding, a supporting jig is pressed against the back side of the land portion via the circular hole. Thereby, generated heat is immediately transmitted to the supporting jig, preventing melting part of the frame around the land portion. Pressing force of a thermo-compression jig is received by the supporting jig, preventing sinking of the land portion in the frame.

8 Claims, 13 Drawing Sheets

SPEAKER

BACKGROUND OF THE INVENTION

1. Field of the Invention

The present invention relates to a dynamic speaker, particularly to a structure of fixing a lead wire of a voice coil.

2. Description of the Related Art

A dynamic speaker is conventionally known among the types of a speaker. As shown in JP-A-6-178390, a dynamic speaker comprises a diaphragm having a voice coil attached on the back surface, and a frame disposed on the back side of the diaphragm and adapted to support the diaphragm at the periphery thereof. A pair of lead wire drawn from the voice coil is fixed to a pair of terminal member mounted on the back side of the frame by soldering or other means. The land portion of the terminal member where the lead wire is fixed has the shape of a plate extending along the surface of the frame.

If the frame is made of synthetic resin, part of the frame around the land portion is possibly melted and deformed by heat generated in the process of fixation.

SUMMARY OF THE INVENTION

An object of the present invention is to provide a dynamic speaker comprising a frame made of synthetic resin, which effectively prevents melting of part of the frame around the land portion.

The speaker of the present invention achieves the object by providing a hole or a notch in the frame.

A speaker of the present invention comprises:

a diaphragm;

a voice coil attached to the back surface of the diaphragm;

a frame made of synthetic resin, disposed on the back side of the diaphragm and supporting the diaphragm at the outer edge thereof; and a pair of terminal member mounted on the frame and having a portion where a pair of lead wire drawn from the voice coil is fixed;

wherein the portion has the shape of a plate which extends along the surface of the frame, and a hole or a notch is provided in the frame at the back side of the portion so as to expose the portion to the back space of the frame.

The word such as "back" is used for the purpose of explanation to clarify the positional relationship of the members. The actual direction or orientation of the speaker when operated is not thereby limited.

Any type of "diaphragm" and "voice coil" may be used as far as applicable as an element of a dynamic speaker.

Any type of "terminal member" may be used as far as the portion is made of conductive material and disposed along the surface of the frame. The terminal member may be integrally formed with the frame, or may be fixed on the frame by adhesive or screw.

The lead wire is fixed to the portion of the terminal member for electrical connection. Any type of fixing method is applicable such as soldering and thermo-compression bonding.

The phrase of "extends along the surface of the frame" means that the surface of the land portion is substantially coplanar with or substantially parallel to the surface of the frame.

The "surface of the frame" is not limited to a particular surface. It may be the upper surface, the lower surface, the outer surface or any other.

As described above, according to the speaker of the present invention, the pair of land portion having the shape of a plate is disposed along the surface of the resin frame. The frame has the pair of circular hole or notch on the back side of the pair of land portion formed so as to expose the land portion to the back space of the frame. Heat generated in the process of thermo-compression bonding is diffused to the back space of the frame via the circular hole or the notch.

This invention prevents melting of part of the frame around the land portion.

The supporting jig may be abutted against the back surface of the land portion via the circular hole or the notch. Therefore, heat generated in the process of thermo-compression bonding is immediately transmitted from the land portion to the supporting jig of higher conductivity. This effectively prevents melting of part the frame around the land portion.

The lead wire may be fixed to the land portion by thermo-compression bonding method. This eliminates a conventional soldering process and contributes to an environmental lead-free structure. This effectively reduces a space for fixation since a space for solder spot is not required. Continuity failure is also considerably lessened since this method provides more reliable continuity.

Further, since the thermo-compression bonding jig is stopped by the supporting jig, the land portion is prevented from sinking in the frame even when pressing force is applied from the thermo-compression bonding jig.

The "thermo-compression bonding" is a method applying heat and pressing force. Any type of heating method may be used as far as it melts the insulation coating of the lead wire so that the exposed core of the wire may be pressed against the land portion of the terminal member by pressing force. For example, the following three methods are applicable: 1) supplying current between the lead wires; 2) supplying current between the terminal member and a thermo-compression bonding jig holding the lead wire; and 3) pre-heating the jig and pressing the heated jig against the lead wire.

The pair of circular hole or notch may be so located as to be opposite to the thermo-compression bonded portion of the lead wire. Therefore, heat transmission from the land portion to the supporting jig is available via the shortest path, which prevents melting of the frame effectively. Further, pressing force of the thermo-compression bonding jig is directly received by the supporting jig which prevents sinking of the land portion in the frame effectively.

The pair of terminal member may be integrally formed with the frame by insert molding. This improves the mounting strength of the terminal member, and enables part of the terminal member to be easily protruded outside the speaker. The pair of hole located on the back side of the land portions may be formed by an insert holding member for positioning the pair of terminal member in a mold

DETAILED DESCRIPTION OF THE INVENTION

The present invention will be described below in detail with reference to the accompanying drawings.

Figure 1:
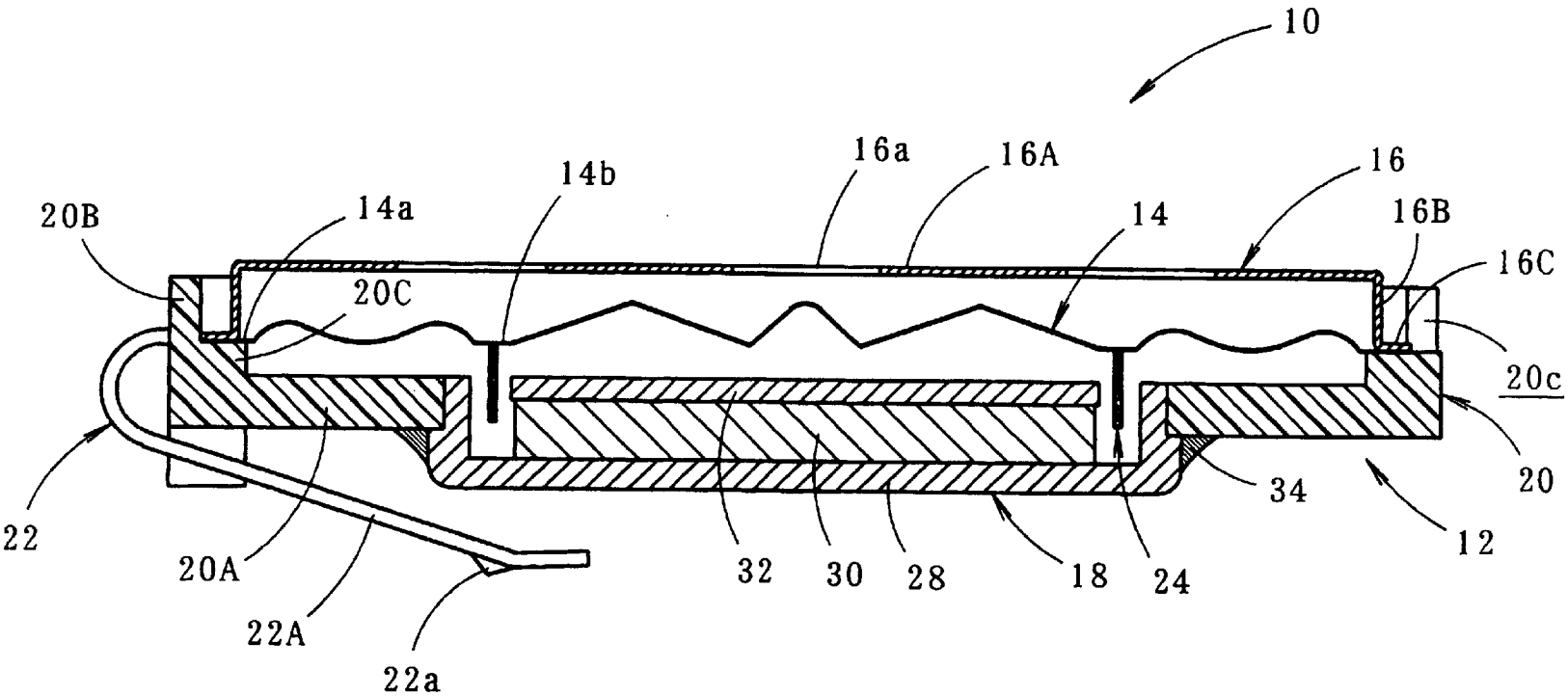
FIG. 1 is a sectional view of a speaker of the present invention facing upward as seen in the drawing
Figure 2:
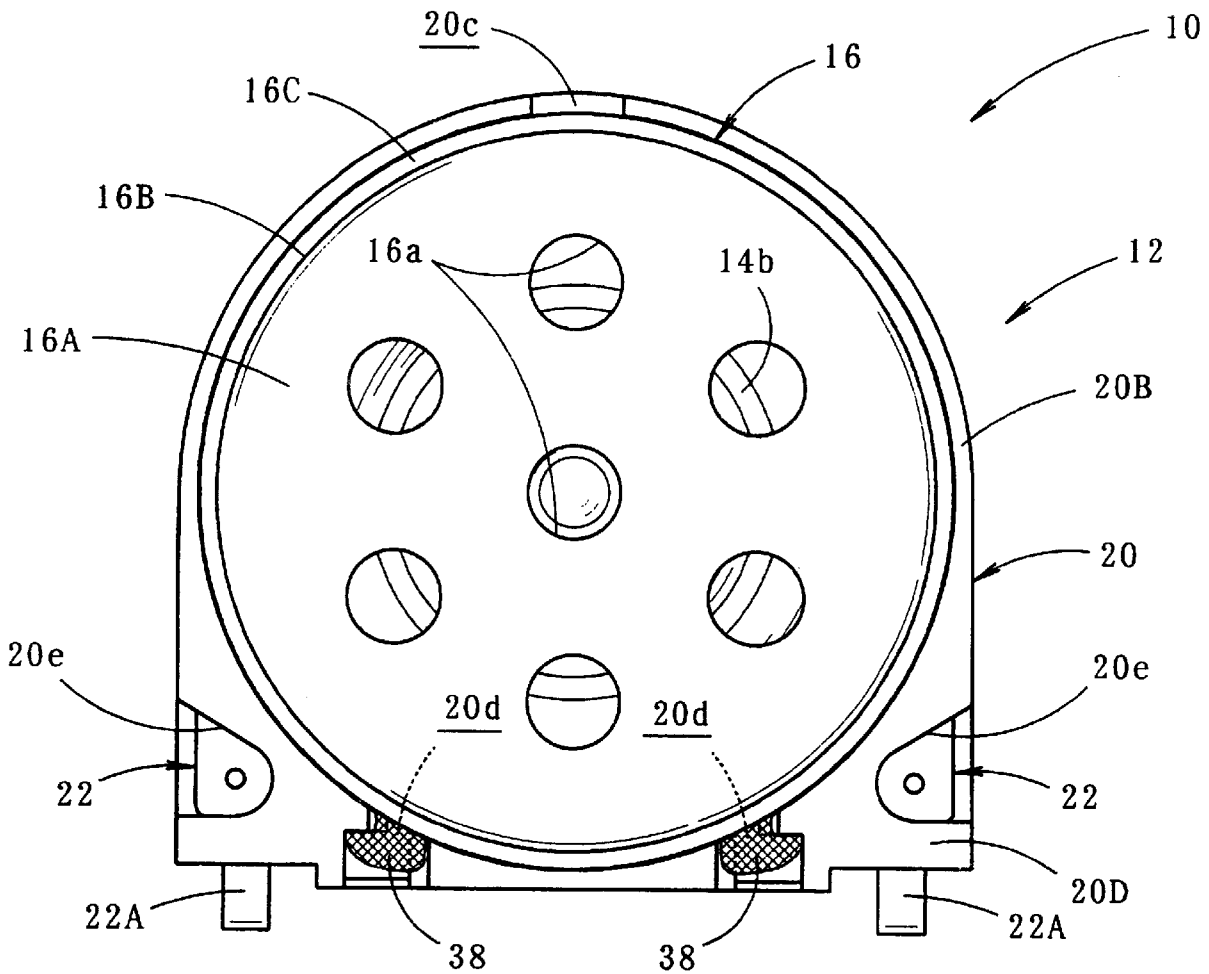
FIG. 2 is a plan view of the speaker.
Figure 3:
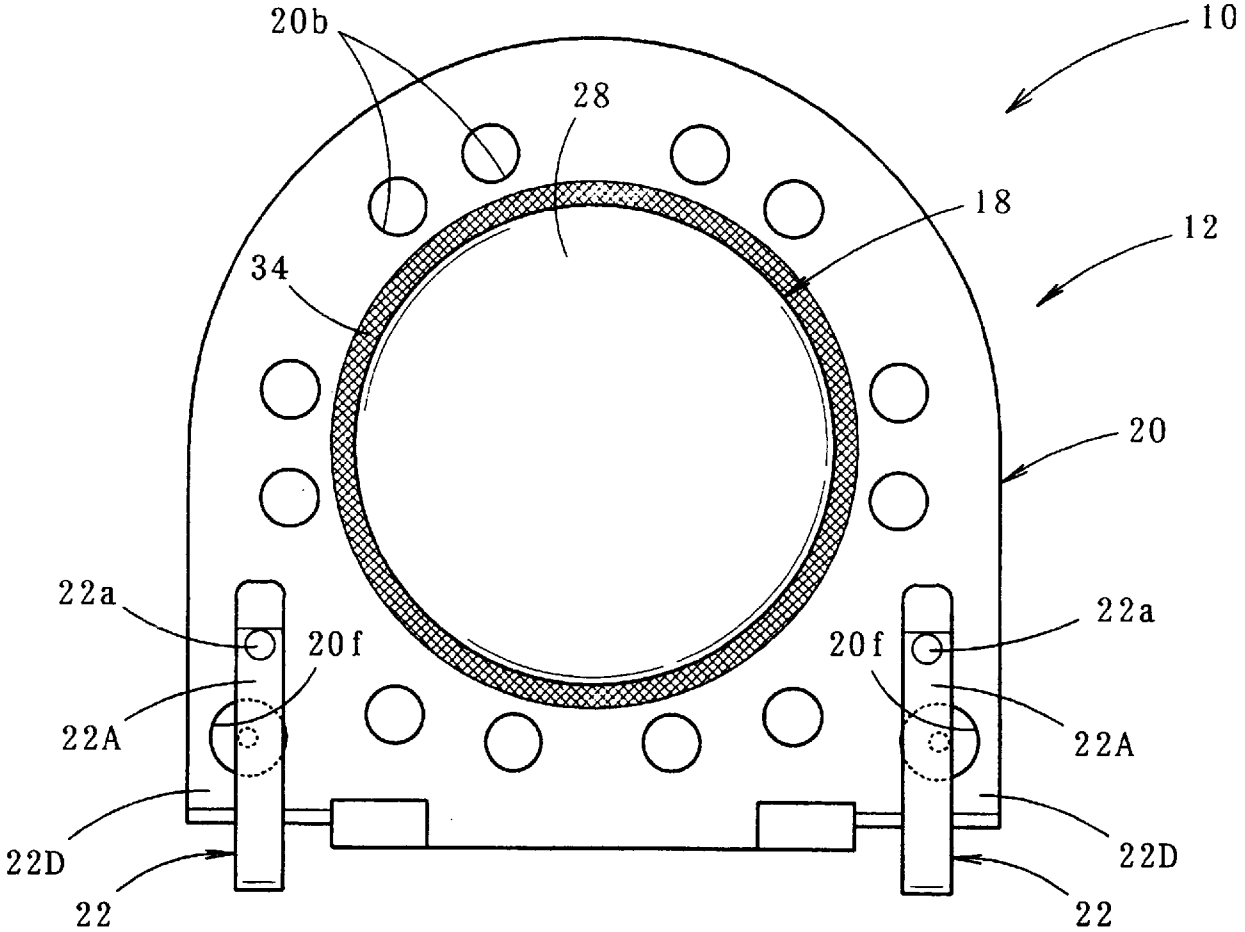
FIG. 3 is a bottom view of the speaker.
Figure 4:
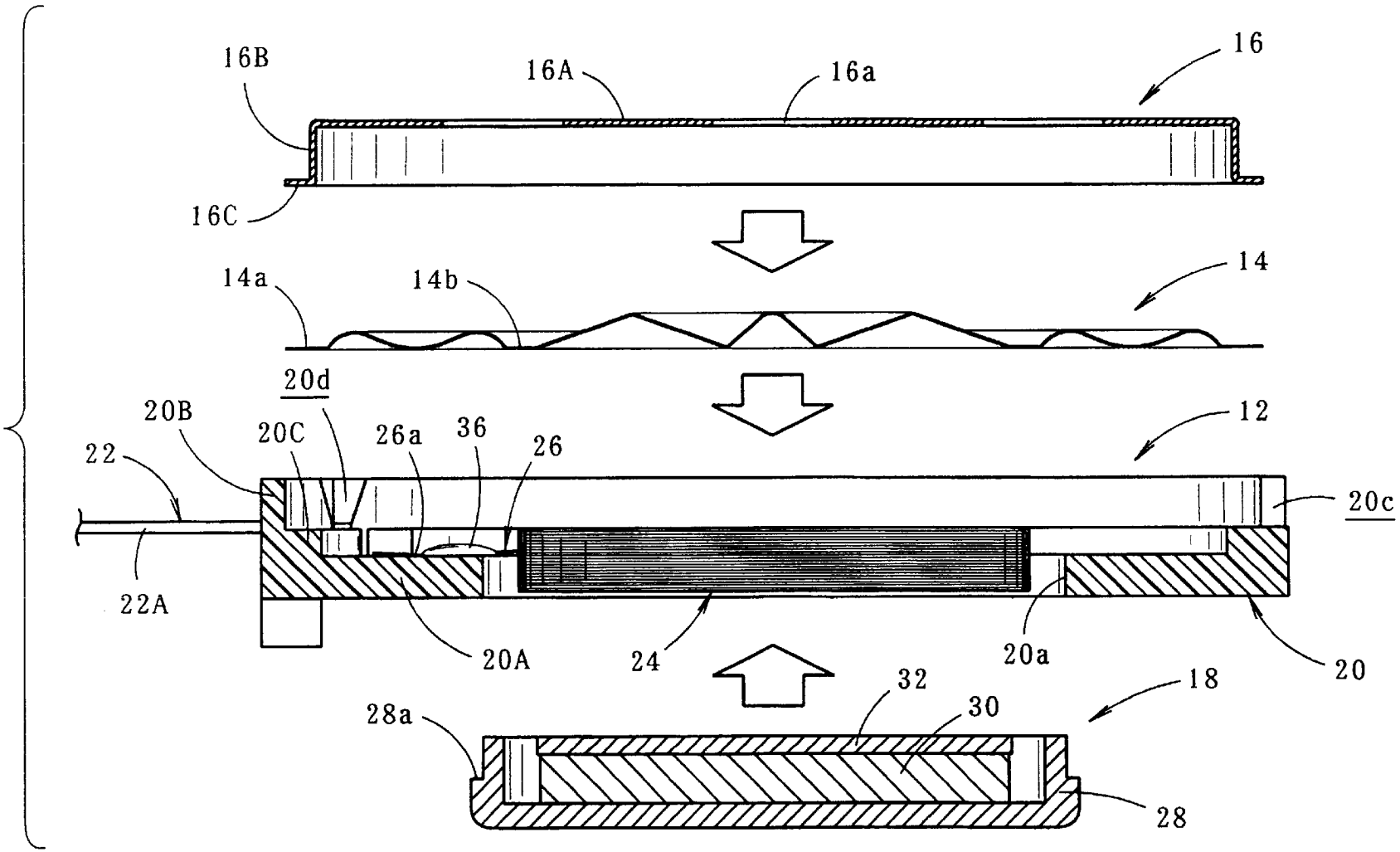
FIG. 4 is an exploded sectional view of the speaker.

FIG. 1 is a sectional view of a speaker 10 of the present invention facing upward as seen in the drawing. FIGS. 2, 3, and 4 are a plan view, a bottom view, and an exploded sectional view respectively showing the speaker 10. For the purpose of explanation only, the right hand of the speaker 10 is referred to as the "front", the left hand is the "rear", the cover 16 side is the "upper", and the magnetic circuit unit 18 side is the "lower."

As shown in these drawings, the speaker 10 is a small dynamic speaker (of an outer diameter of approximately 17 mm) which is mounted in, for example, a mobile phone.

The speaker 10 comprises a frame subassembly 12, a diaphragm 14 and a cover 16 respectively mounted on the upper side of the frame subassembly 12, and a magnetic circuit unit 18 mounted on the lower side of the frame subassembly 12.

Figure 5:
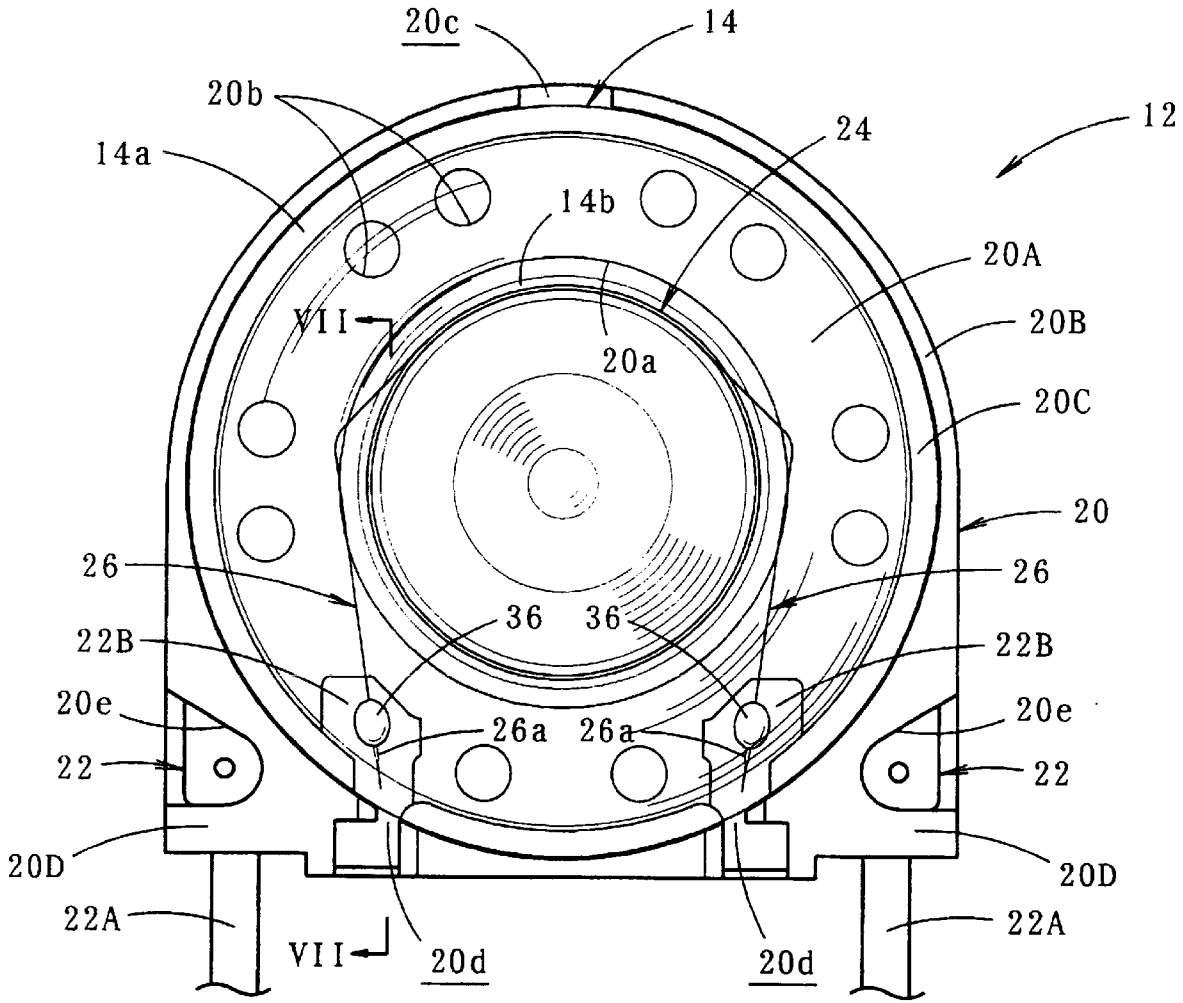
FIG. 5 is a plan view of a frame subassembly with a diaphragm mounted thereon.
Figure 6:
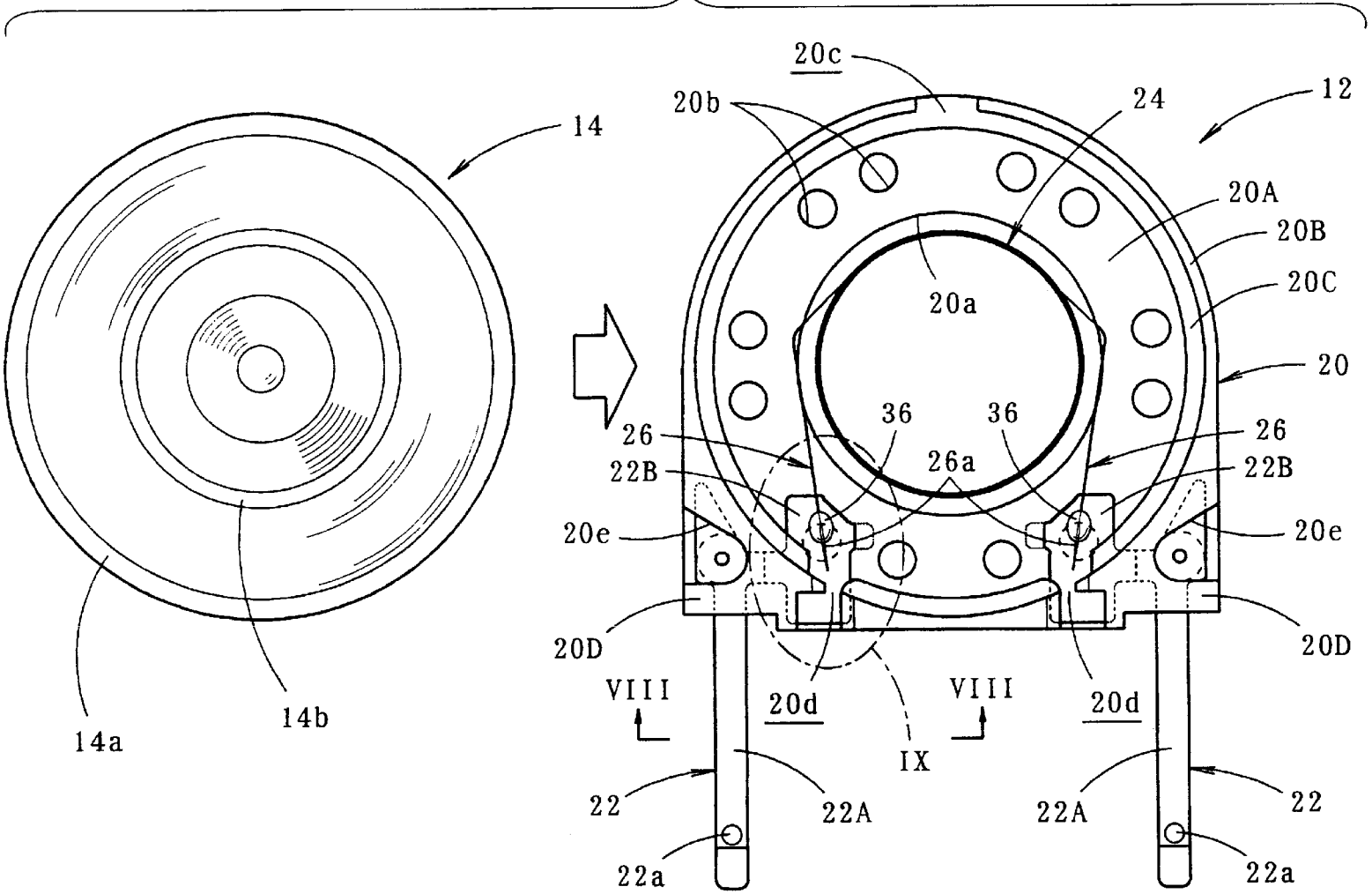
FIG. 6 is a plan view of the frame subassembly and the diaphragm separately.
Figure 7:
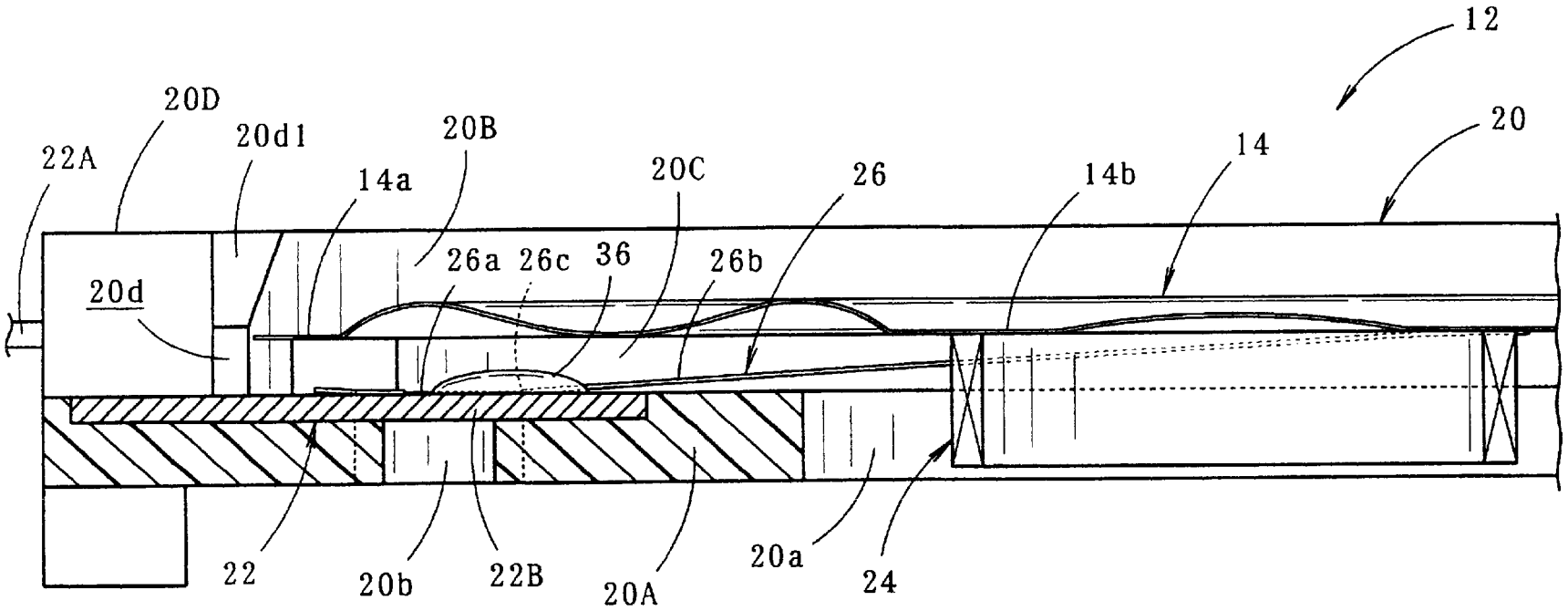
FIG. 7 is a sectional view of the VII—VII line in FIG. 5.
Figure 8:
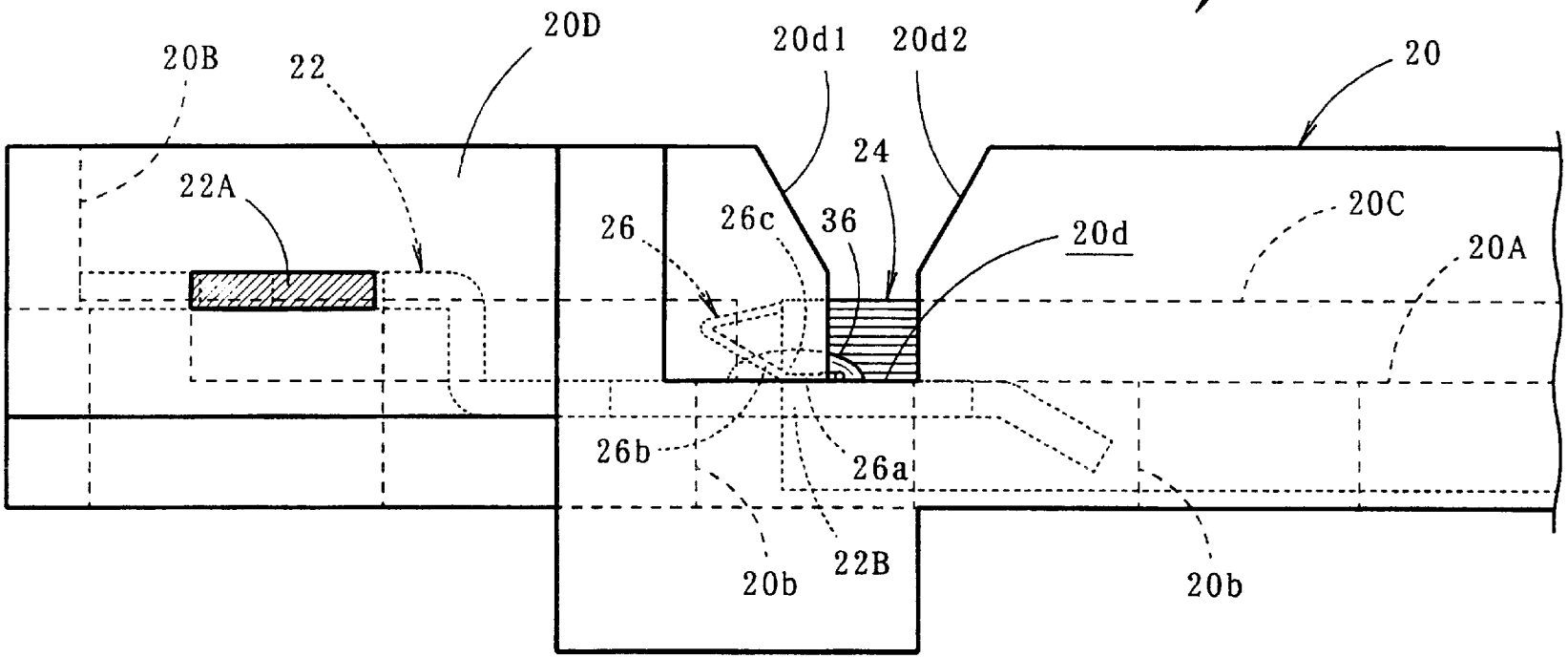
FIG. 8 is a sectional view of the VIII—VIII line in FIG. 6.

FIG. 5 is a plan view showing the frame subassembly 12 having the diaphragm 14 mounted thereon (the cover 16 and the magnetic circuit unit 18 are not mounted). FIG. 6 is a plan view showing the frame subassembly 12 and the diaphragm 14 separately. FIG. 7 is a sectional view of the VII—VII line in FIG. 5. FIG. 8 is a sectional view of the VIII—VIII line in FIG. 6.

As shown in these drawings, the frame subassembly 12 comprises a frame 20, a pair of terminal member 22 and a voice coil 24.

The frame 20 is made of polyamide resin by injection molding. There is formed at the center of the frame 20 a circular opening 20*a* of a larger diameter than the voice coil 24. The frame 20 further comprises an annular bottom 20A surrounding the circular opening 20*a* and a circumferential wall 20B extending upward from the outer edge of the annular bottom 20A. At the inner side of the wall 20B, there is formed an annular stepped portion 20C which is higher than the annular bottom 20A. A pair of terminal support portion 20D is formed in the frame 20 at the rear corners behind the wall 20B.

There are circumferentially formed twelve circular holes 20*b* in the annular bottom 20A at given intervals. The wall 20B has a notched portion 20*c* at the front thereof and a pair of guide groove 20*d* (described later) at the inner side of the pair of terminal support portion 20D. The notched portion 20*c* is coplanar with the upper surface of the stepped portion 20C. The pair of guide groove 20*d* is coplanar with the upper surface of the annular bottom 20A.

The pair of terminal member 22 is made of phosphor bronze by pressing or bending, and integrally formed with the frame 20 by insert molding. The terminal member 22 is partially embedded in the terminal support portion 20D, comprising a plate spring 22A projecting rearward from the rear surface of the terminal support portion 20D and a land portion 22B (a portion for electrical continuity) extending along the upper surface of the annular bottom 20A into the inner side of the wall 20B.

The plate spring 22A is bent downward in the shape of a letter "U" and extended forward in an oblique manner below the lower surface of the annular bottom 20A. The leading end of the plate spring is slightly bent upward, and a conical downward projection 22*a* is provided around the leading end. The plate spring 22A is initially straight and later bent downward in the shape of a letter "U" after the diaphragm 14, the cover 16, and the magnetic circuit unit 18 are mounted on the frame subassembly 12 and the magnetic circuit unit 18 is magnetized.

The upper surface of the land portion 22B is coplanar with the upper surface of the annular bottom 20A. The land portion 22B is extended to the outer side of the wall 20B via each guide groove 20*d* toward the vicinity of the rear end of the terminal support portion 20D. Such extension of the land portion 22B to the outer side of the wall 20B is not necessarily required.

The voice coil 24 is disposed in the circular opening 20*a* with the upper end being coplanar with the upper surface of the stepped portion 20C. A pair of lead wire 26 drawn from the upper end of the voice coil 24 is guided toward the land portion 22B of the pair of terminal member 22. The lead wire 26 is fixed to the land portion 22B at the portion near the leading end thereof by thermo-compression bonding (described later) and thereby they are electrically connected.

Since the upper surface of the land portion 22B is placed lower than the upper end of the voice coil 24, the lead wire 26 is angled down toward the rear. In this embodiment, the upper surface of the land portion 22B is lower than the upper end of the voice coil 24 by approximately 0.4 to 0.5 mm.

The lead wire 26 is first directed sideways and then re-directed toward the rear. This structure guarantees an enough length of the lead wire 26 in case the voice coil 24 is moved up and down, and also allows the path of the lead wire 26 to be easily defined.

The diaphragm 14 is made of polyether-imide (PET) film by thermal press molding, having a plurality of irregularity concentric to each other. There are formed a circumferential flat portion 14*a* (outer edge) and an intermediate flat portion 14*b*. They are annular flat surfaces on the same horizontal plane. The diaphragm 14 is bonded to the upper surface of the stepped portion 20C at the circumferential flat portion 14*a* and bonded to the upper end of the voice coil 24 at the intermediate flat portion 14*b*.

The bonding of the diaphragm 14 is being described. First, adhesive is applied to the upper surface of the stepped portion 20C and the lower surface of the intermediate flat portion 14*b* respectively, second the diaphragm 14 is placed on the frame 20, and then visible light is irradiated at the contact surfaces from above. Applied adhesive is thereby hardened.

The cover 16 is made of stainless steel by press molding, comprising a circular top surface 16A having a plurality of sound emitting holes 16*a* formed at given positions thereon, a short cylindrical portion 16B extending downward from the outer edge of the circular top surface 16A, and an annular flange portion 16C radially extending outward from the bottom end of the cylindrical portion 16B. The cover 16 is bonded to the upper surface of the circumferential flat portion 14*a* and the stepped portion 20C at the flange portion 16C.

The magnetic circuit unit 18 comprises a steel base 28, a magnet 30, and a steel yoke 32.

The base 28 has the shape of a bottomed cylinder. An annular stepped portion 28*a* is formed at the upper circumference thereof. The magnet 30 and the yoke 32 has the shape of a disk respectively and placed and bonded in this order on the bottom of the base 28 so as to be concentric to each other. A cylindrical gap is thereby formed between the outer surface of the yoke 32 and the inner surface of the base 28, having the same width over the entire circumference so as to accommodate a lower portion of the voice coil 24 in the gap.

The magnetic circuit unit 18 is mounted on the frame 20 in the following manner. The annular stepped portion 28*a* of the base 28 is fitted into the circular opening 20*a* of the frame 20, and then adhesive is applied around the joint portion of the outer surface of the base 28 and the lower surface of the annular bottom 28A.

There are twelve circular holes 20*b* formed on the annular bottom 20A. Two of them 20*b* are located below the land portions 22B and each having an upper end closed by the land portion 22B. Each of the other holes 20*b* is a through hole penetrating the annular bottom 20A serving as an escape for any pressure generated in the space formed by the diaphragm 14, the frame 20 and the magnetic circuit unit 18 when the diaphragm 14 is vibrated. The pair of hole 20*b* located on the back side of the land portions 22B is formed by an insert holding member set in a mold when the frame 20 is formed by injection molding. The insert holding member holds and positions the terminal member 22 in a predetermined position in the mold.

The terminal supporting portion 20D of the frame 20 has a notched portion 20*e* on the upper surface and a circular hole 20*f* on the lower surface. The notched portion 20*e* and the circular hole 20*f* are also formed by the insert holding member when the frame 20 is formed by injection molding.

As described above, the lead wire 26 is thermo-compression bonded to the land portion 22B and thereby they are electrically connected. A thermo-compression bonded portion 26*a* of the lead wire 26 is covered by an overcoat 36.

Figure 9:
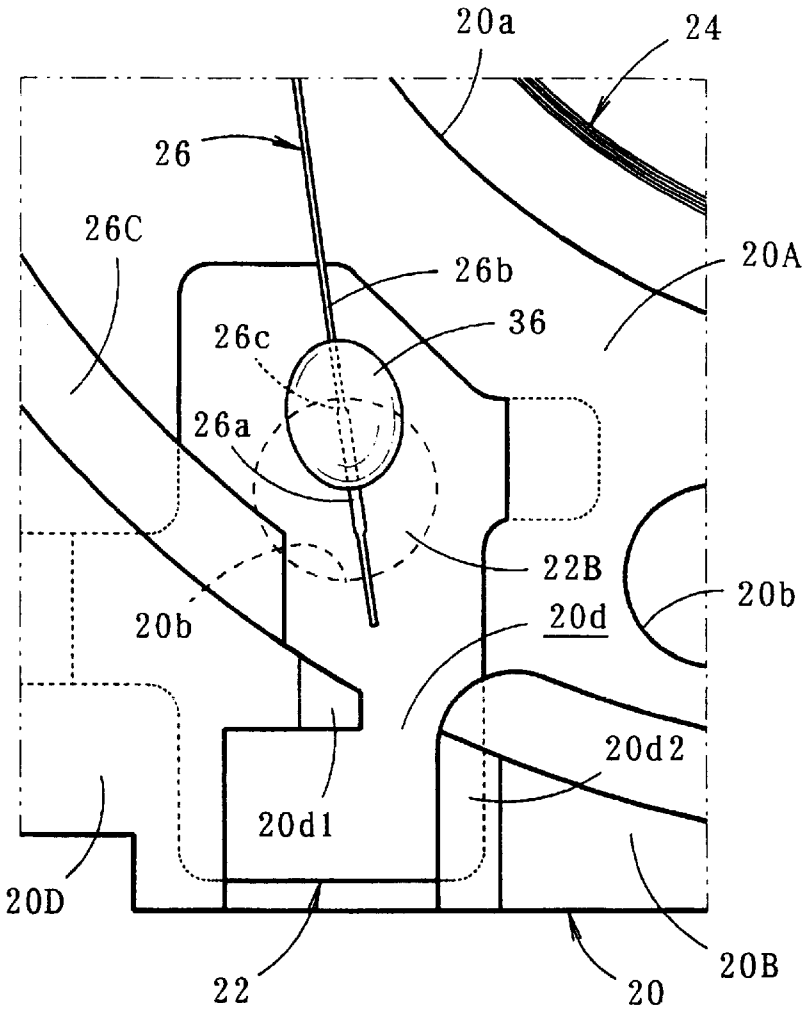
FIG. 9 is a detailed drawing of the IX part in FIG. 6 comprising FIG. 9(*a*) showing a thermo-compression bonding and FIG. 9(*b*) showing an overcoat.
Figure 9:
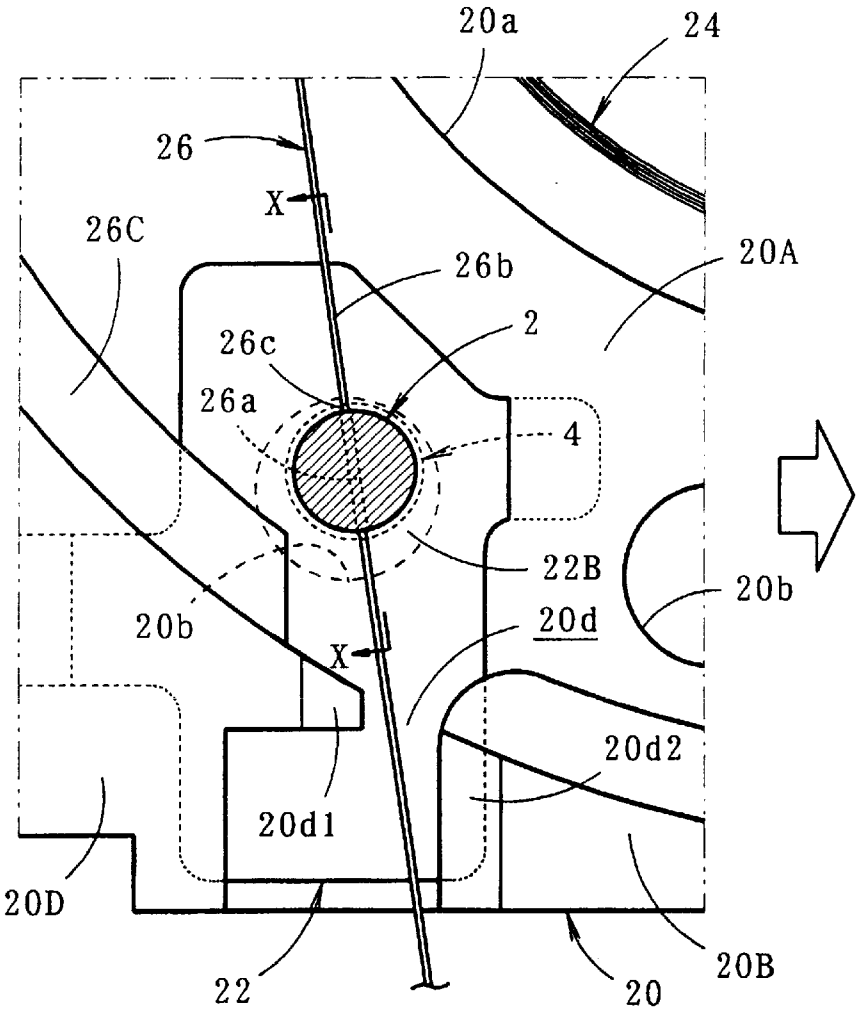
Figure 10:
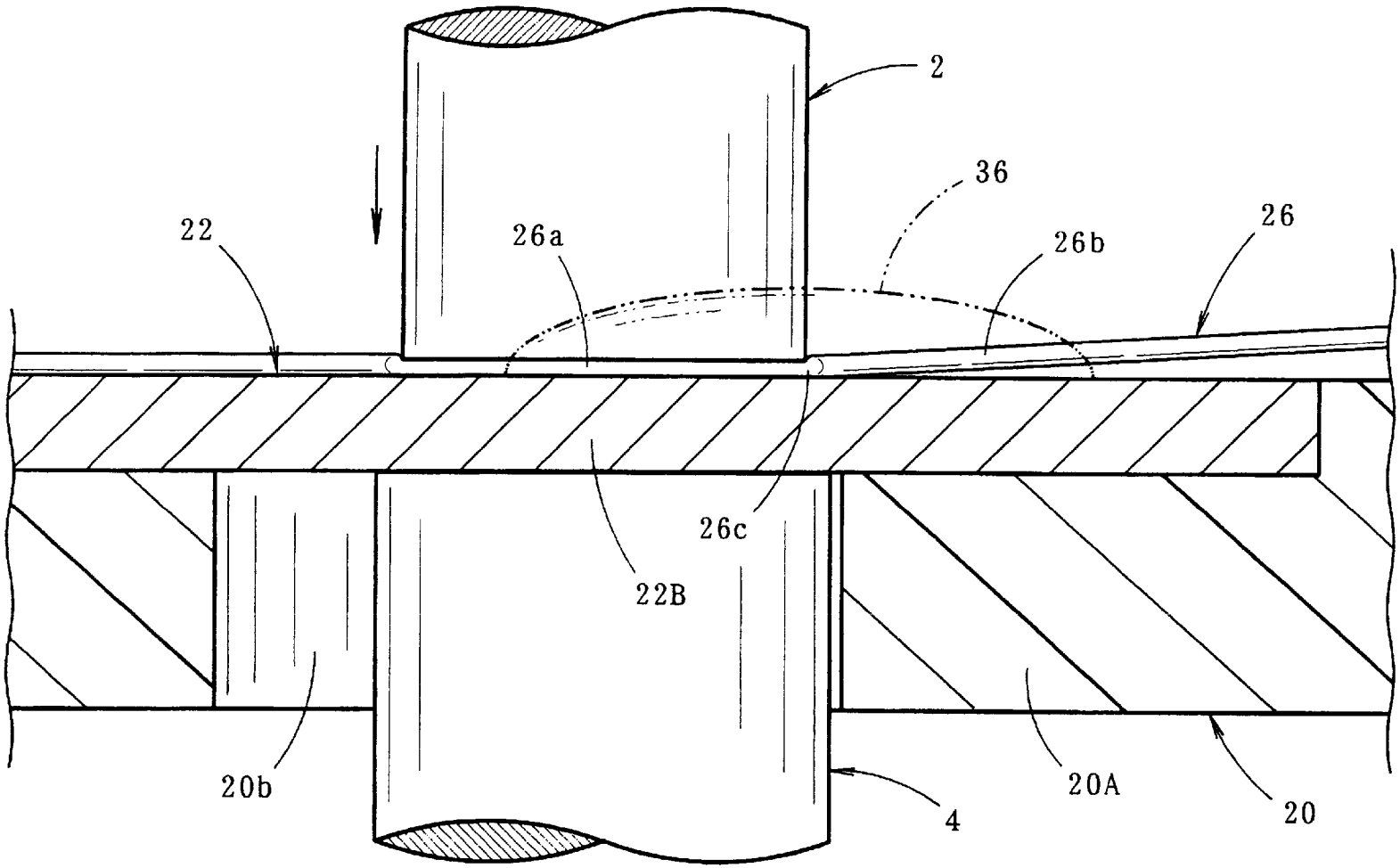
FIG. 10 is a sectional view of the X—X line in FIG. 9(*a*).

FIG. 9(*b*) is a detailed drawing of the IX part in FIG. 6. FIG. 9(*a*) shows the thermo-compression bonded portion 26A before the overcoat 36 is applied. FIG. 10 is a sectional view of the X—X line in FIG. 9(*a*).

The method of the thermo-compression bonding is being described referring to the left-hand lead wire 26.

As shown in FIGS. 9(*a*) and 10, a metal pin or a supporting jig 4 is inserted from under the circular hole 20*b* until the leading end of the jig 4 abutting a target position on the back surface of the land portion 22B. The lead wire 26 (a long wire before finally cut) is guided along the groove 20*d* so as to pass the target position. Another metal pin or a thermo-comression bonding jig 2 is lowered from above the target position until it presses the lead wire 26 against the land portion 22B by a predetermined force. While the lead wire 26 is pressed by the thermo-compression bonding jig 2, an instant energization (approximately 20 to 30 msec) is applied between the thermo-compression bonding jig 2 and the supporting jig 4. Joule heat generated there amounts to 600 degrees centigrade or more to melt an insulation coating of the lead wire 26. The lead wire 26 is fixed to the land portion 22B with the exposed core being pressed against the land portion 22B.

After completion of the thermo-comression bonding, the leading portion of the lead wire 26 beyond the thermo-compression bonded portion 26*a* is cut off.

Generated heat is immediately transmitted from the land portion 22B to the supporting jig 4 of higher conductivity than the frame 20. This prevents melting of the frame 20, particularly the area around the land portion 22B. Since the thermo-compression bonding jig 2 is stopped by the supporting jig 4, the land portion 22B is prevented from sinking in the frame 20 even when pressing force is applied from the thermo-compression bonding jig 2.

As shown in FIG. 8, the guide groove 20*d* formed in the frame 20 has tapered side surfaces 20*d*1 and 20*d*2 so that the groove 20*d* has the entire shape of a letter of "Y" as seen from the rear. This structure allows the lead wire 26 to be easily guided in the groove 20*d*.

The thermo-compression bonded portion 26*a* is deformed to be substantially flat compared to the other general portions of the lead wire 26. The thermo-compression bonded portion 26*a* and the neighborhood suffers degradation such as deterioration of the core and lower tensile strength. A general portion 26*b* of the lead wire 26 which is nearer to the voice coil 24 than the thermo-compression bonded portion 26*a* is moved up and down in accordance with the movement of the voice coil 24. Therefore, an intervening portion 26*c* connecting the general portion 26*b* and the thermo-compression bonded portion 26*a* is subjected to stress concentration due to such repeated bending load, and the lead wire 26 is easy to be broken at the intervening portion 26*c*.

In this embodiment, the intervening portion 26*c* and the neighborhood is covered by the overcoat 36 to guard against stress concentration. Adhesive applied on the intervening portion 26*c* is hardened by ultraviolet irradiation so as to serve as the overcoat 36.

As shown in FIG. 2, an overcoat 38 is applied on a plate portion of the land portion 22B extended to the rear side of the wall 20B via each guide groove 20*d* after the diaphragm 14 and the cover 16 is mounted on the frame subassembly 12. The pair of guide groove 20*d* is thereby closed.

As described above, according to the speaker 10 of the present invention, the pair of land portion 22B is disposed along the surface of the annular bottom 20A of the resin frame 20, and the pair of lead wire 26 is fixed on the land portion 22B by thermo-compression bonding. The frame 20 has the pair of circular hole 20*b* on the back side of the pair of land portion 22B. Since the circular hole 20*b* is opened to the back space of the frame 20, heat generated in the process of thermo-compression bonding is diffused to the back space of the frame 20 via the circular hole 20*b*.

The supporting jig 4 is abutted against the back surface of the land portion 22B via the circular hole 20*b*. Therefore, heat generated in the process of thermo-compression bonding is immediately transmitted from the land portion 22B to the supporting jig 4. This prevents melting of part the frame 20 around the land portion 22B. Further, since the thermo-compression bonding jig 2 is stopped by the supporting jig 4, the land portion 22B is prevented from sinking in the frame 20 even when pressing force is applied from the thermo-compression bonding jig 2.

This invention prevents melting of part of the frame 20 around the land portion 22B, and sinking of the land portion 22 in the frame 20.

In this embodiment, the pair of circular hole 20*b* is so located as to be opposite to the thermo-compression bonded portion 26*a* of the lead wire 26. Therefore, heat transmission from the land portion 22B to the supporting jig 4 is available via the shortest path, which prevents melting of the frame 20 effectively. Further, pressing force of the thermo-compression bonding jig 2 is directly received by the supporting jig 4, which prevents sinking of the land portion 22B in the frame effectively.

In this embodiment, the pair of terminal member 22 is integrally formed with the frame 20 by insert molding. This improves the mounting strength of the terminal member 22, and enables the plate spring 22A of the terminal member 22 to be easily protruded outside the speaker 10. The pair of hole 20*b* located on the back side of the land portions 22B may be formed by an insert holding member for positioning the pair of terminal member 22 in a mold.

Another embodiment of the invention is described below.

Figure 11:
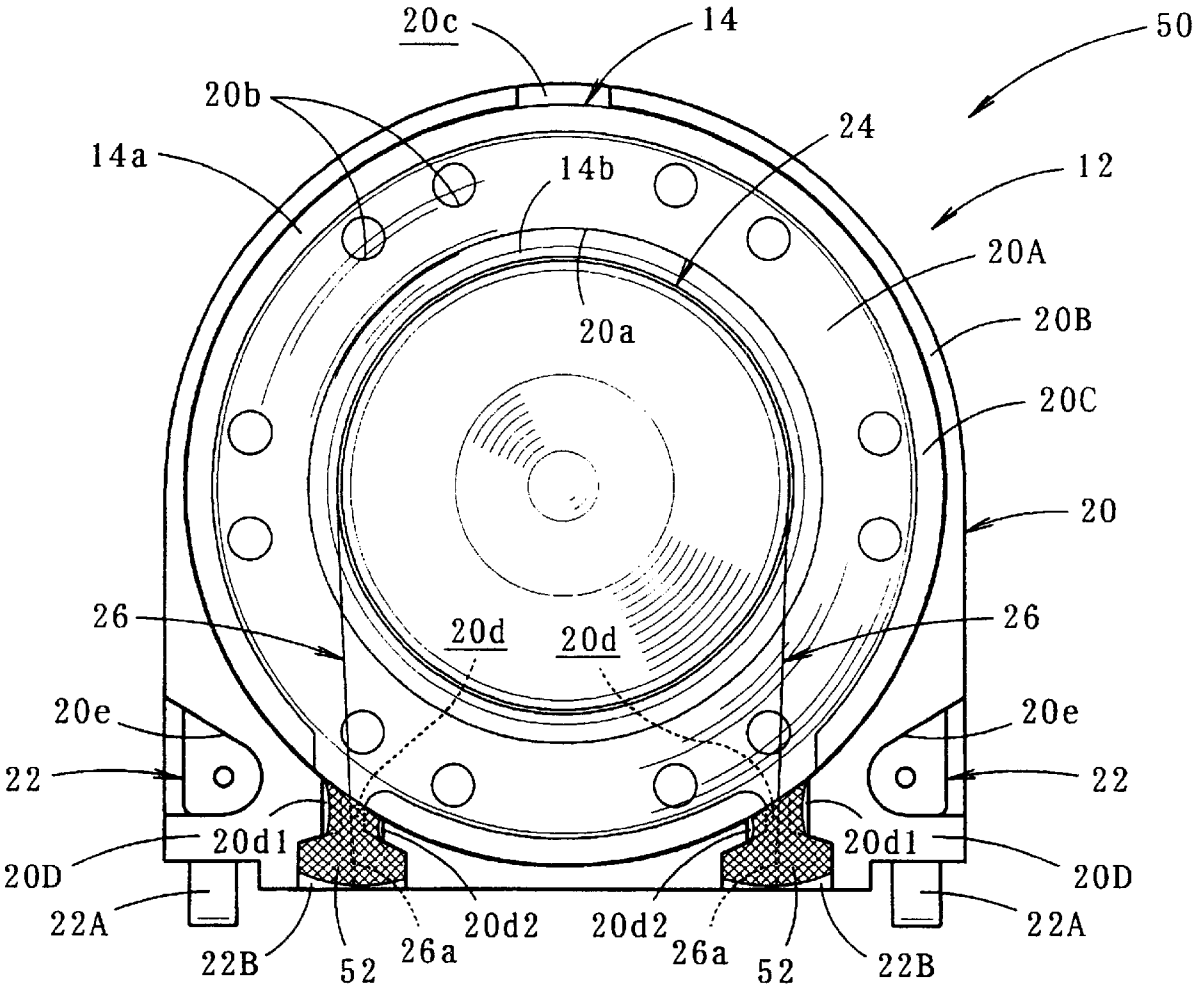
FIG. 11 is a plan view of a speaker of another embodiment.
Figure 12:
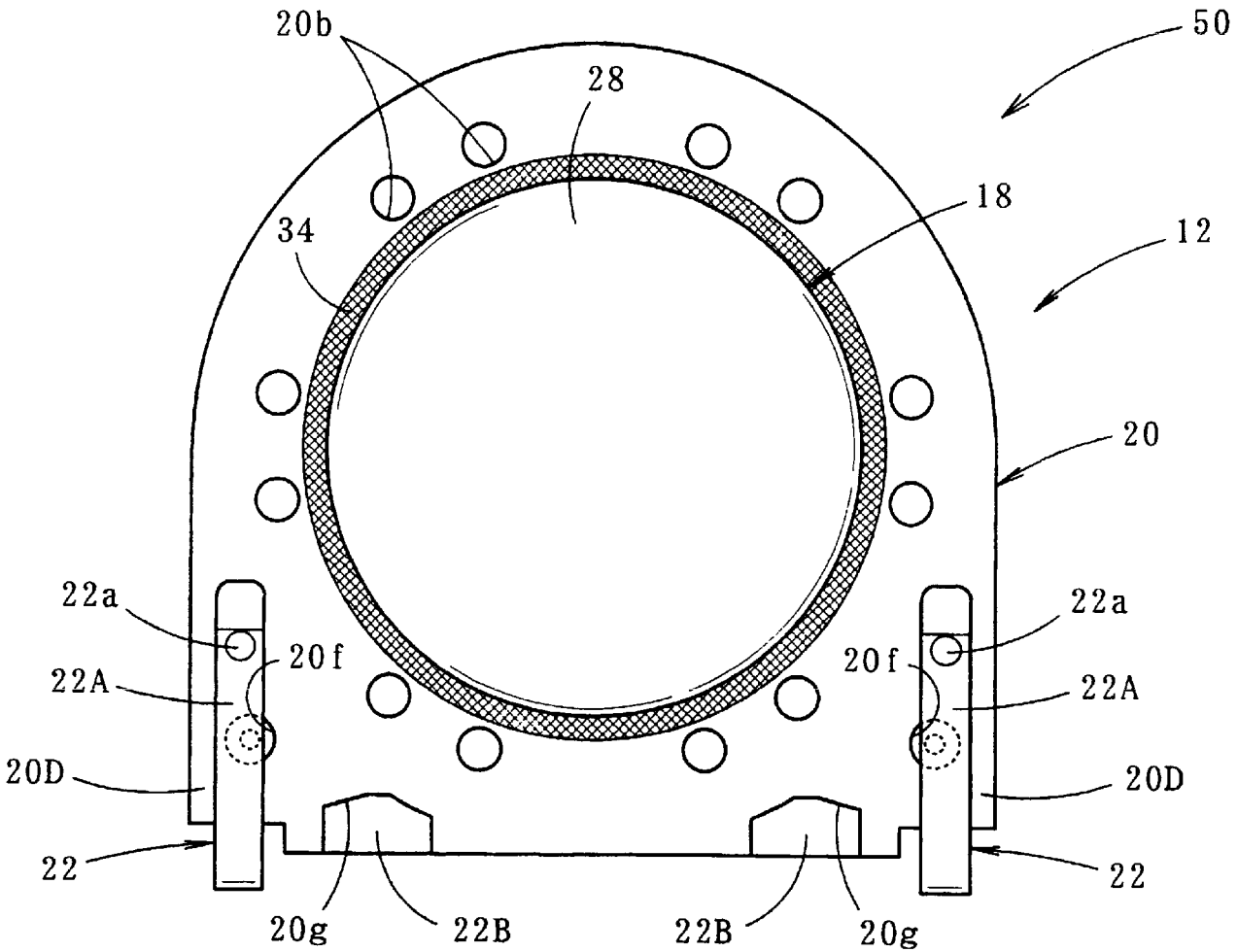
FIG. 12 is a bottom view of the speaker of FIG. 11.
Figure 13:
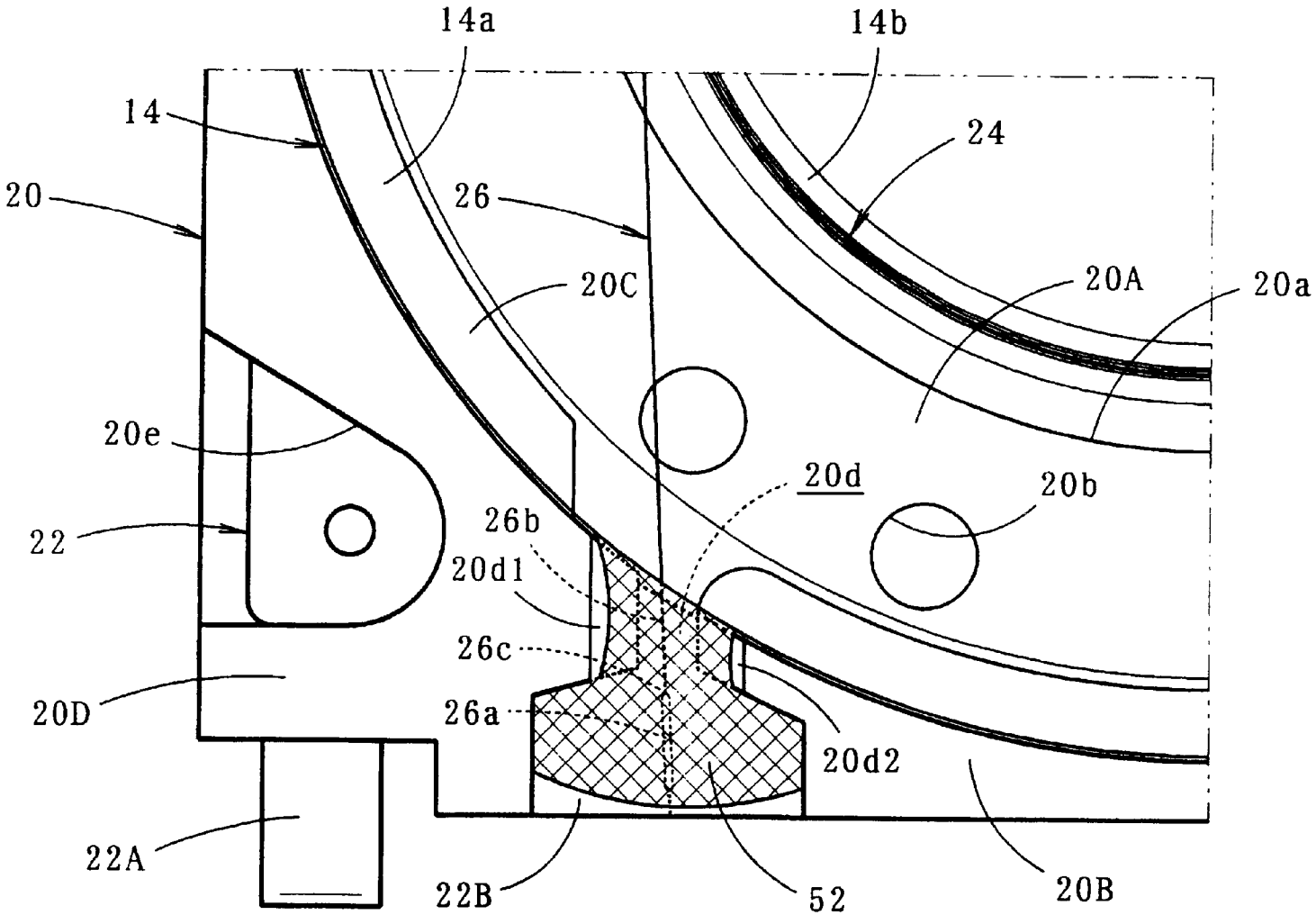
FIG. 13 is a detailed drawing of part of FIG. 11.

FIGS. 11 and 12 are a plan view and a bottom view respectively of the speaker 50 of the another embodiment. FIG. 13 is a detailed drawing of part of FIG. 11.

As shown in these drawings, the speaker 50 is a smaller dynamic speaker (of an outer diameter of approximately 13 mm) than the speaker 10. The structure of the speaker 50 is the same as that of the speaker 10 except that the land portion 22B is disposed outside the circumferential flat portion 14*a* of the diaphragm 14.

An overcoat 52 is applied on the thermo-compression bonded portion 26*a* of the lead wire 26 and guide grooves 20*d* are covered by the overcoat 52. A pair of notched portion 20*g* is formed on the back surface of the frame 20 to expose the land portion 22B to the back space of the frame 20.

According to the speaker 50 of the present invention, the pair of land portion 22B is disposed along the surface of the annular bottom 20A of the resin frame 20, and the pair of lead wire 26 is fixed on the land portion 22B by thermo-compression bonding. The frame 20 has the pair of notched portion 20*g* on the back side of the pair of land portion 22B to expose the land portion 22B to the back space of the frame 20. Heat generated in the process of thermo-compression bonding is diffused to the back space of the frame 20 via the notched portion 20*g*. The supporting jig 4 may be abutted against the back surface of the land portion 22B via the notched portion 20*g*.

This another embodiment also provides the same effects as the first embodiment.

In the first and second embodiments, the lead wire 26 may be fixed to the terminal member 22 by other means than the thermo-compression bonding such as soldering. The same effects as described above is obtained. Heat generated in the process of soldering is diffused to the back space of the frame 20, thereby melting of the frame 20 is prevented. Pressing force is received by the supporting jig 4, thereby sinking of the land portion 22B is prevented.

What is claimed is:

1. A speaker comprising:

a diaphragm;

a voice coil attached to the back surface of the diaphragm;

a frame made of synthetic resin, disposed on the back side of the diaphragm and supporting the diaphragm at the outer edge thereof, and a pair of terminal member mounted on the frame and having a portion where a pair of lead wire drawn from the voice coil is fixed;

wherein the portion where the pair of lead wire is fixed has the shape of a plate which extends along the surface of the frame, a hole or a notch is provided in the frame at the back side of the portion where the pair of lead wire is fixed so as to expose the portion where the pair of lead wire is fixed to the back space of the frame; and each of the pair of lead wire is bonded by compression bonding on the front side of the portion where the pair of lead wire is fixed.

2. The speaker as claimed in claim 1, wherein the pair of lead wire is fixed on the portion by thermo-compression bonding.

3. The speaker as claimed in claim 2, wherein the hole or the notch is so located as to be substantially opposite to a fixed portion of the lead wire.

4. The speaker as claimed in claim 2, wherein the pair of terminal member is integrally formed with the frame by insert molding.

5. The speaker as claimed in claim 1, wherein the hole or the notch is so located as to be substantially opposite to a fixed portion of the lead wire.

6. The speaker as claimed in claim 5, wherein the pair of terminal member is integrally formed with the frame by insert molding.

7. The speaker as claimed in claim 1, wherein the pair of terminal member is integrally formed with the frame by insert molding.

8. The speaker as claimed in claim 1, wherein the hole or the notch is closed by the portion where the pair of lead wire is fixed.

* * * * *